United States Patent [19]

Smith

[11] 4,406,350

[45] Sep. 27, 1983

[54] SAFETY DEVICE FOR LADDERS

[76] Inventor: Samuel D. Smith, "Jamada", Newton of Pitcairns, Dunning, Perthshire, England

[21] Appl. No.: 383,228

[22] Filed: May 28, 1982

[30] Foreign Application Priority Data

May 29, 1981 [GB] United Kingdom ..... 8116447

[51] Int. Cl.[3] ..... E06C 7/18; A62B 1/16

[52] U.S. Cl. ..... 182/8; 182/9

[58] Field of Search ..... 182/8, 3, 4–7, 182/9

[56] References Cited

U.S. PATENT DOCUMENTS

| | | | |
|---|---|---|---|
| 1,477,738 | 12/1923 | White . | |
| 2,678,243 | 5/1954 | Masse . | |
| 2,886,227 | 5/1959 | Rose | 182/8 |
| 3,561,563 | 8/1969 | Harsh . | |
| 3,885,647 | 5/1975 | Acosta | 182/8 |
| 4,085,818 | 4/1978 | Swager | 182/8 |
| 4,130,177 | 12/1978 | Pandolph | 182/8 |
| 4,169,518 | 10/1979 | Schmoock | 182/8 |

FOREIGN PATENT DOCUMENTS

| | | | |
|---|---|---|---|
| 425596 | 6/1911 | France . | |
| 1473300 | 2/1967 | France . | |
| 566201 | 8/1957 | Italy | 182/8 |
| 284436 | 2/1928 | United Kingdom . | |
| 1251938 | 11/1971 | United Kingdom | 182/8 |
| 1501945 | 10/1978 | United Kingdom | 182/8 |

*Primary Examiner*—Reinaldo P. Machado
*Attorney, Agent, or Firm*—Warren B. Kice

[57] ABSTRACT

A device for supporting a person on a ladder in which a frame is provided for extending around the ladder with sufficient clearance to move relative to said ladder. A portion of the frame extends at an angle relative to the remaining frame and inwardly towards the ladder. The frame can be connected to the person at a position that of said angularly-extending portion so that movement of the person downwardly on said ladder causes said angularly-extending portion to move between the ladder stays and engage a rung on said ladder to prevent further downward movement.

7 Claims, 5 Drawing Figures

SAFETY DEVICE FOR LADDERS

BACKGROUND OF THE INVENTION

This invention relates to a safety device for use on ladders, and more particularly to a device for attaching to a belt, or the like to support a person on a ladder.

SUMMARY OF THE INVENTION

According to the present invention there is provided a safety device for use on ladders, comprising a frame adapted to loosely girdle a ladder for sliding movement along the ladder and having an angularly extending portion which can locate in the plane of the rungs to engage over a rung and prevent downward movement of the device.

Preferably, the angularly-extending portion forms part of a side member which, when the device is mounted on a ladder, extends across one face of the ladder parallel to the rungs. A second side member is located across the opposite face of the ladder, and two end members are provided which space the side members apart and are of a length greater than the depth of the ladder rung supports. As a result, the angularly-extending portion can move towards or away from the plane of the rungs so that, in the latter position the device can move relative to the ladder.

Preferably, the main frame of the safety device is substantially rectangular and planar and the angularly extending portion is angled relative to the remainder of the frame at an angle of approximately 20° to the plane. Also, a spring clasp for attachment to a harness, or belt, is preferably located on the aforementioned second side member.

BRIEF DESCRIPTION OF THE DRAWINGS

An embodiment of the present invention will now be described, by way of example with reference to the accompanying drawings, in which.

DESCRIPTION OF THE PREFERRED EMBODIMENT

Figure 1:
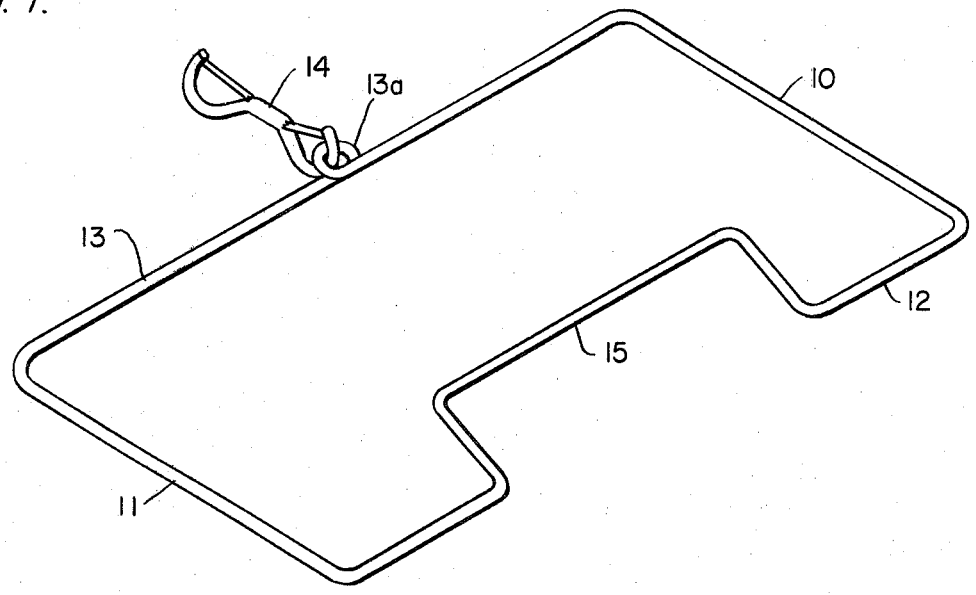
FIG. 1 is a perspective view of a safety device according to the invention.
Figure 2:
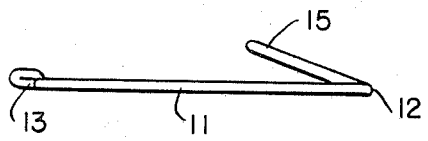
FIG. 2 is an end view of the device of FIG. 1.

The device of the present invention is shown in detail in FIGS. 1 and 2, and comprises a substantially rectangular metal frame having two end members 10 and 11 and two side members 12 and 13. One side member 13 has a loop 13*a* which carries a spring clasp 14 for connection to a belt, or the like, of a person. The other side member 12 has a central portion 15, of a substantially U-shaped configuration, which extends a short distance into the area of the rectangle, and at an angle to the plane of the rectangle of approximately 20°, as better shown in FIG. 2.

Figure 3:
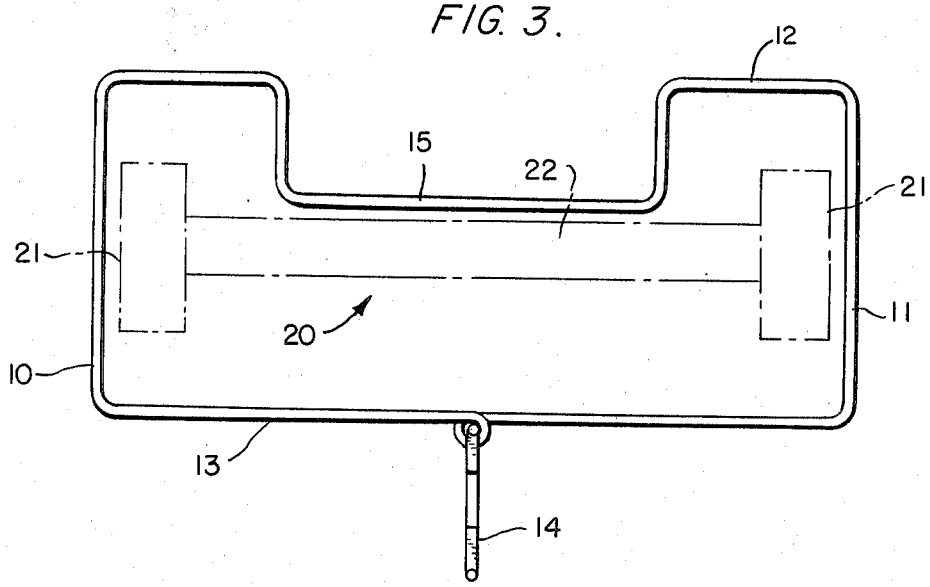
FIG. 3 is a plan view showing the device of the present invention girdling a ladder; and FIG. 4

The device is shown mounted on a ladder 20 in FIG. 3 so as to girdle it for sliding movement up and down the ladder. The end members 10 and 11 are longer than the depth of the ladder rung supports, or stays, 21 so that the device is loosely mounted for transverse and angular movements relative to the rungs 22 and to and from a person on the ladder 20.

Figure 5:
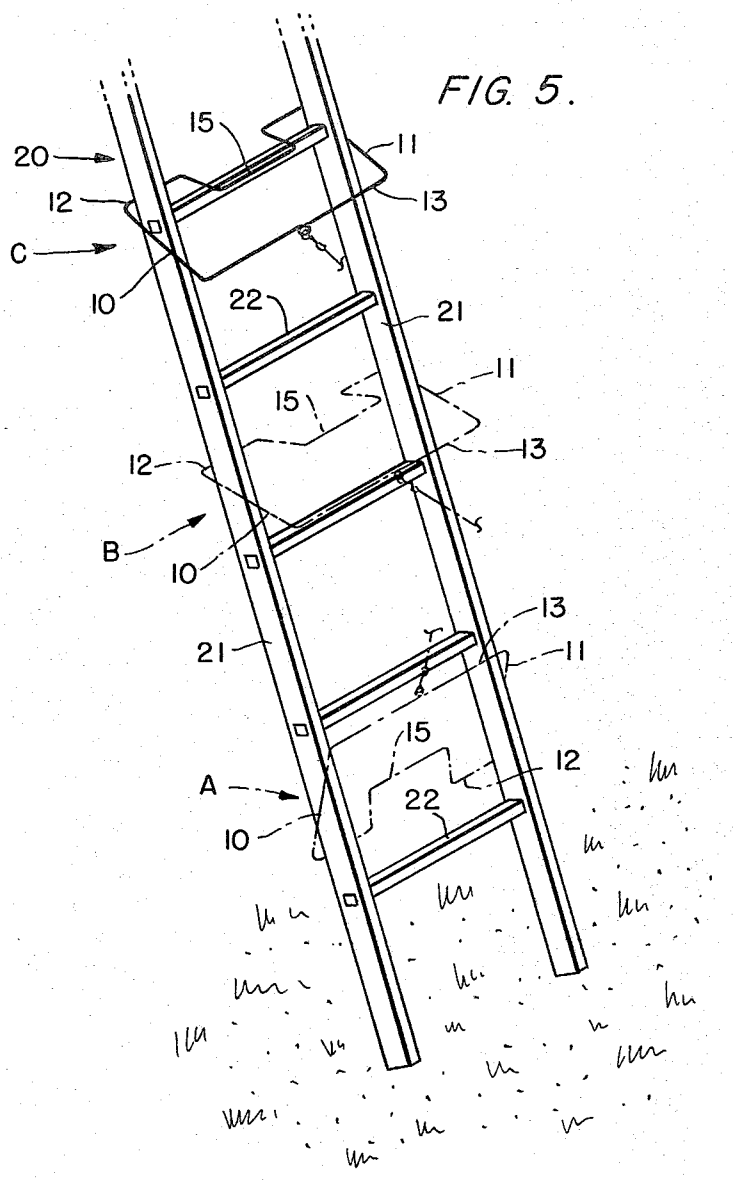
FIG. 5 is a side view and a perspective view, respectively, illustrating three positions of the device when in use on a ladder.
Figure 4:
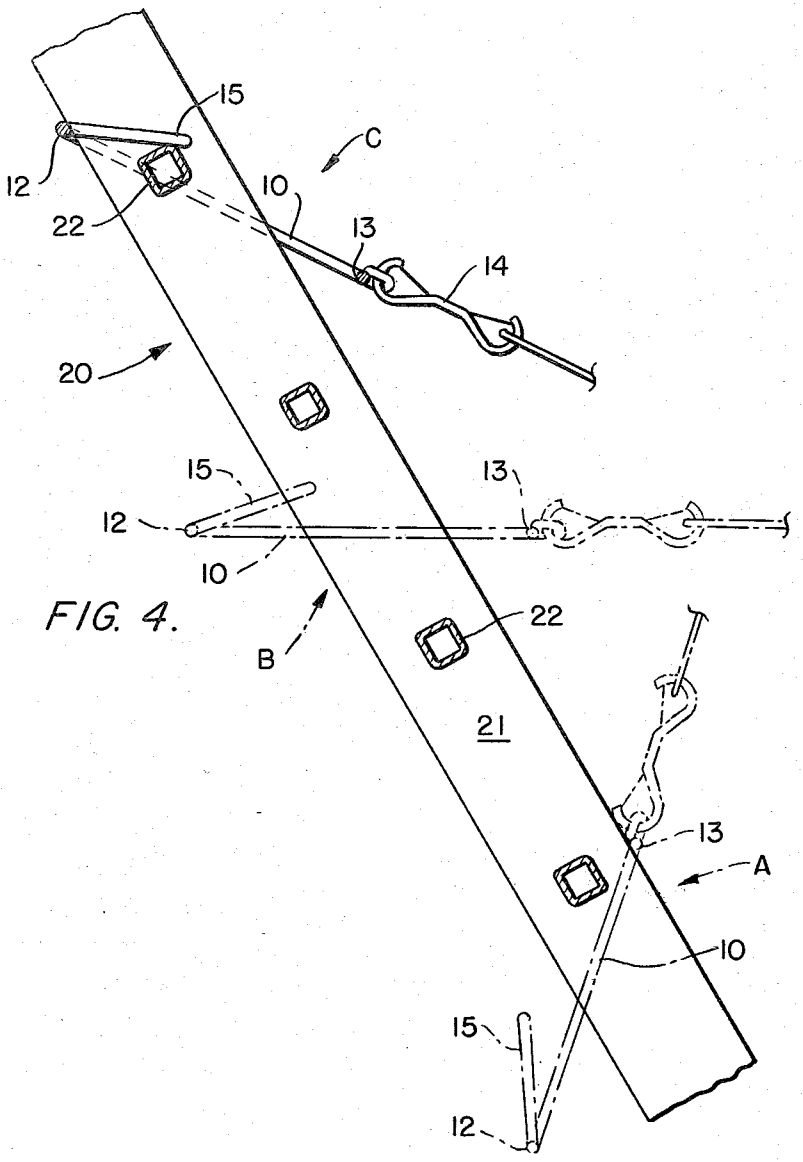

FIGS. 4 and 5 depict the device of the present invention in three different angular positions. Position A illustrates the normal angular disposition of the device in which it can freely slide up or down the ladder 20. In this position, the abutment side 12 of the frame lies horizontally below the other side 13 and the angularly-extending portion 15 is disposed substantially upright, while the side 13 tends to rest upon the stays 21 of the latter 20. As a result, the portion 15 is outside the plane of the rungs and does not impede movement of the device.

In position B, the frame is disposed substantially horizontally and the angularly-extending portion 15 is drawn towards the ladder rungs 22 so as to lie in the plane of the rungs. Thus, downward movement of the device in this position will result in the portion 15 engaging the next lower rung 22. Position C indicates such an engagement which causes the other side 13 to move horizontally below the level of the portion 15.

A person using the device will place it around the ladder 20 as shown in FIG. 3 and connect the spring clasp 14 to his belt, or the like. The person can then climb or descent the ladder 20 with the device in the position A. If the person loses balance or footing and begins to slide or fall, the device will move into position B and quickly thereafter into position C to hold the person against further downward movement. Provided the ladder 20 is secured or stabilized, a person harnessed to the device as hereinbefore described should be secured against falling. The ladder 20 may be secured, e.g., by ropes or hooks at its upper end, or stabilized by a ladder attachment such as described and claimed in applicant's copending U.S. application Ser. No. 277,829, filed June 26, 1981.

The space between the abutment 15 and the end members 10 and 11 of the device is greater than the width of the ladder stays 21 so that a slight lateral movement of the device is possible. Thus, the user can reach sideways of the ladder a short distance beyond his normal reach while the device will prevent further, excessive sideways movement.

The device may be manufactured from a metal rod bent to the required shape and welded at the abutting ends.

While the device of the present invention is primarily intended as a safety device for a person moving up or down a ladder, it can also be used by the person as an anchoring device when the person is working at a particular position on the ladder. In this mode, the user would simply tilt the device so that the abutment hooks over the nearest convenient rung. A person using the device need not hold on to the ladder and so can use his hands for other purposes such as carrying tools or equipment.

A latitude of modification, change and substitution is intended in the foregoing disclosure and in some instances some features of the invention will be employed without a corresponding use of other features. Accordingly, it is appropriate that the appended claims be construed broadly and in a manner consistent with the spirit and scope of the invention therein.

What is claimed is:

1. A device for supporting a person on a ladder comprising a frame adapted to extend around said ladder with sufficient clearance to move relative to said ladder, at least a portion of said frame extending at an angle relative to the remaining frame portion, said angularly extending portion extending inwardly towards said ladder and having a length less than the distance between the stays of said ladder, and means on said frame at a position opposite that of said angularly-extending portion for connecting to a belt, or the like, on said person, so that movement of said person downwardly on said ladder causes said angularly-extending portion to move between said stays and engage a rung on said ladder to prevent further downward movement.

2. The device of claim 1 wherein said frame comprises two end members and two side members connected together in a substantial rectangular configuration, with said side members extending parallel to the rungs of the ladder.

3. The device of claim 2 wherein said angularly-extending portion is formed by a portion of one of said side members.

4. The device of claim 3 wherein said angularly-extending portion is formed by a portion of said one side member bent into a substantially U-shaped configuration.

5. The device of claim 3 wherein said connecting means is formed on the side member of said frame opposite said one side member.

6. The device of claim 2 wherein the length of the rectangle formed by said end members and said side members is slightly greater than the width of said ladder and the width of said rectangle is greater than the depth of said ladder.

7. The device of claim 1 wherein said angle is approximately 20°.

* * * * *